US011576511B2

(12) United States Patent
Patel et al.

(10) Patent No.: US 11,576,511 B2
(45) Date of Patent: Feb. 14, 2023

(54) MAT FACILITATING CLEAN UP

(71) Applicants: Priti T. Patel, Anaheim, CA (US); Tejalkumar M. Patel, Anaheim, CA (US)

(72) Inventors: Priti T. Patel, Anaheim, CA (US); Tejalkumar M. Patel, Anaheim, CA (US)

( * ) Notice: Subject to any disclaimer, the term of this patent is extended or adjusted under 35 U.S.C. 154(b) by 596 days.

(21) Appl. No.: 16/808,375

(22) Filed: Mar. 4, 2020

(65) Prior Publication Data

US 2020/0315384 A1 Oct. 8, 2020

Related U.S. Application Data

(60) Provisional application No. 62/813,521, filed on Mar. 4, 2019.

(51) Int. Cl.

| | |
|---|---|
| ***A47G 27/02*** | (2006.01) |
| ***A47G 11/00*** | (2006.01) |
| ***A45F 3/14*** | (2006.01) |

(52) U.S. Cl.

CPC ..... *A47G 27/0206* (2013.01); *A45F 3/14* (2013.01); *A47G 11/003* (2013.01); *A45F 2003/142* (2013.01)

(58) Field of Classification Search

CPC .. A47G 27/0206; A47G 11/003; A47G 9/092; A45F 3/14; A45F 2003/142; A45F 4/00; A45F 4/02; A47D 15/003; A45C 9/00; A45C 7/0077; A45C 2007/0004; A01G 13/0281

USPC ..... 428/12; 383/4, 67; 294/149, 152; 224/575, 577

See application file for complete search history.

(56) References Cited

U.S. PATENT DOCUMENTS

| | | | | |
|---|---|---|---|---|
| 2,519,678 A * | 8/1950 | McKenzie | A01D 46/26 | 56/329 |
| 3,976,113 A * | 8/1976 | Kim | A45C 9/00 | 383/4 |
| 4,058,956 A * | 11/1977 | Skonieczny | A01G 13/0281 | 47/1.01 R |
| 4,188,988 A * | 2/1980 | Agyagos | A45C 3/00 | 383/18 |
| 4,489,815 A * | 12/1984 | Martinez | A45F 4/02 | 229/189 |
| 5,002,401 A * | 3/1991 | Blackman | A45C 7/0095 | 190/127 |

(Continued)

FOREIGN PATENT DOCUMENTS

DE 202015103319 U1 * 8/2015 ..... A01G 1/12

*Primary Examiner* — Scott T McNurlen
*Assistant Examiner* — Lester L Vanterpool
(74) *Attorney, Agent, or Firm* — Eric Kelly

(57) ABSTRACT

A mat may be transitioned into at least three different operational configurations: (1) a substantially flat work surface configuration, for using the mat as a work or play surface; (2) a funnel like collection configuration, for facilizing collection and/or clean-up of articles upon a top of the mat; and (3) a folded configuration, for storage of the mat. The mat may have a removably sealable trapdoor for emptying of articles collected above the trapdoor. The trapdoor may be utilized in the funnel like collection configuration. Straps and/or handles may be used to transition from the substantially flat work surface configuration to the funnel like collection configuration.

20 Claims, 10 Drawing Sheets

(56) References Cited

U.S. PATENT DOCUMENTS

| | | | | | |
|---|---|---|---|---|---|
| D408,233 | S | * | 4/1999 | Price | D8/1 |
| 6,128,852 | A | * | 10/2000 | Hansen | A01G 20/40 47/1.01 R |
| 7,028,870 | B2 | * | 4/2006 | Valdez-Campbell | A45C 7/0095 224/684 |
| 7,188,713 | B1 | * | 3/2007 | Espar | A45F 4/06 383/4 |
| D582,676 | S | * | 12/2008 | Rothschild | D3/276 |
| 7,597,209 | B2 | * | 10/2009 | Rothschild | A45C 15/00 220/6 |
| 7,845,508 | B2 | * | 12/2010 | Rothschild | A45F 4/02 220/4.08 |
| 8,061,896 | B2 | * | 11/2011 | Delgado | B65D 33/105 206/549 |
| 8,991,512 | B2 | * | 3/2015 | George | E21B 21/015 172/25 |
| 9,032,575 | B2 | * | 5/2015 | Sebor | E04H 4/1654 15/1.7 |
| 9,060,581 | B2 | * | 6/2015 | Lown | A45C 11/20 |
| 9,151,076 | B2 | * | 10/2015 | George | E04H 17/26 |
| 9,428,931 | B2 | * | 8/2016 | Samaripa | A45F 4/06 |
| 9,475,614 | B2 | * | 10/2016 | Rittenour | B65F 1/14 |
| 10,653,219 | B2 | * | 5/2020 | Camburn | A45C 7/00 |
| 2017/0216701 | A1 | * | 8/2017 | Buck | A45C 13/002 |
| 2021/0115632 | A1 | * | 4/2021 | Van Sant | A47G 9/06 |

* cited by examiner

MAT FACILITATING CLEAN UP

PRIORITY NOTICE

The present application claims priority under 35 U.S.C. § 119(e) to U.S. Provisional Patent Application Ser. No. 62/813,521 filed on Mar. 4, 2019, the disclosure of which is incorporated herein by reference in its entirety.

TECHNICAL FIELD OF THE INVENTION

The present invention relates in general to substantially flat work or play surfaces and more specifically to such surfaces that may be mobile, such as a mat, and that may facilitate easy and efficient clean-up of articles used on top of the given surface (mat).

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

It is often desirable to use a substantially flat surface as a supportive substrate (e.g., a ground, a floor, a table top, etc.) for working with and/or for playing with various articles, that may be about hand sized or smaller. For example, when playing with small toys, such as, building blocks, further such as, but not limited to LEGOs, it may be desirable to play and build on top of a substantially flat surface. However, because of the relatively small size of such building blocks and their possible numerosity, cleaning up after use may be time consuming and/or inefficient.

This problem is not limited to cleaning up of groups of small toys, but rather is a problem for cleaning up any group of hand sized articles or smaller. This problem exists with the clean-up of: small toys, gaming parts, hobby components, crafting components, assembly components, and/or the like.

It would be desirable if the substantially flat surface used as the substrate surface could aid and facilitate timely and efficient clean-up of the various articles used on top of the given substantially flat surface.

There is a need in the art for a mat, that in one configuration may function as the substantially flat surface substrate (e.g., something that functions as a flat ground, floor, tabletop, etc. in one configuration), but that may in another configuration facilitate clean-up of articles used on top of the mat.

It is to these ends that the present invention has been developed.

BRIEF SUMMARY OF THE INVENTION

To minimize the limitations in the prior art, and to minimize other limitations that will be apparent upon reading and understanding the present specification, the present invention describes embodiments of a mat that may be transitioned into at least three different operational configurations: (1) a substantially flat work surface configuration, for using the mat as a work or play surface; (2) a funnel like collection configuration, for facilizing collection and clean-up of articles upon the mat; and (3) a folded configuration, for storage of the mat. The mat may have a removably sealable trapdoor for emptying of articles collected above the trapdoor. The trapdoor may be utilized in the funnel like collection configuration. Straps and/or handles may be used to transition from the substantially flat work surface configuration to the funnel like collection configuration.

It is an objective of the present invention to provide a mat that may exist in a substantially flat work surface configuration.

It is another objective of the present invention to provide a mat that may exist in a funnel like configuration to collecting articles upon the mat.

It is another objective of the present invention to provide a mat, with a bottom trapdoor, that may exist in a funnel like configuration, for depositing/releasing articles that have been collected on top of the mat.

It is another objective of the present invention to provide a mat that may be exist in a substantially folded configuration for storage of the mat.

It is another objective of the present invention to provide a mat that may be transitioned from one of three different operational configurations: (1) a substantially flat work surface configuration, for using the mat as a work or play surface; (2) a funnel like collection configuration, for facilizing collection and clean-up of articles upon the mat; and (3) a folded configuration, for storage of the mat.

It is another objective of the present invention to provide a mat that facilitates clean-up of articles upon a top of the mat.

It is another objective of the present invention to provide a mat that facilitates collection of articles upon a top of the mat.

It is another objective of the present invention to provide a mat that saves the user time with collecting articles used on top of the mat.

It is another objective of the present invention to provide a mat that saves the user time with cleaning up of articles used on top of the mat.

It is another objective of the present invention to provide a mat with a removably openable/closeable trapdoor for emptying the mat of articles collected above the trapdoor.

It is another objective of the present invention to provide a mat that is easy to wipe down and clean the mat itself.

It is yet another objective of the present invention to provide a mat that is quick and easy to use.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1A:
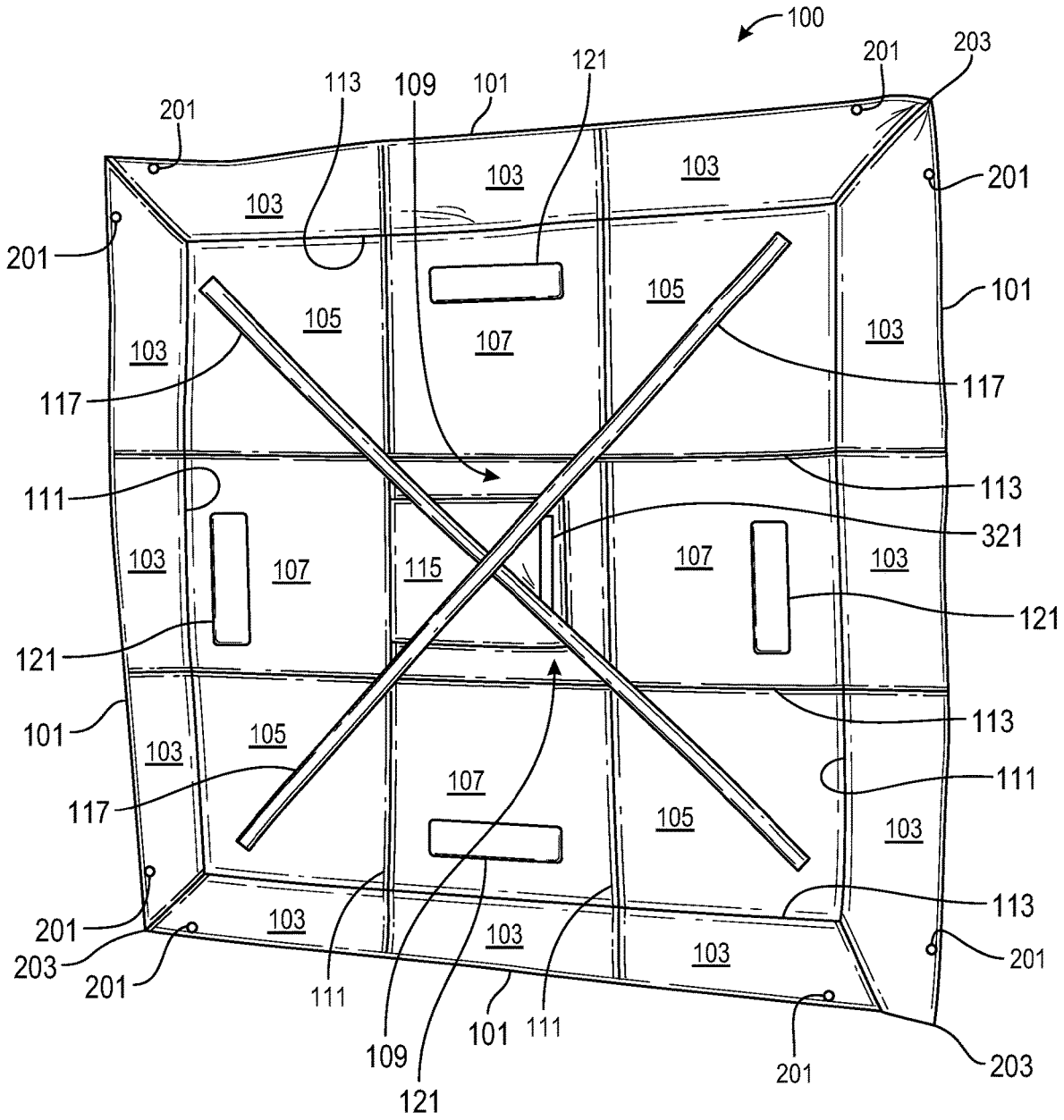
FIG. 1A may depict a mat from a top perspective view.

100 mat 100
101 outer edge 101
103 border 103
105 corner panel 105
107 side panel 107
109 panel-for-door (at least one central panel) 109
111 flex strip 111
113 bend strip 113
115 trapdoor 115
117 strap 117
121 handle 121
201 fastener 201
203 corner 203
205 fastener 205
321 handle 321
401 door-opening 401
403 fastener 403
421 handle 421
801 fold line 801

DETAILED DESCRIPTION OF THE INVENTION

Figure 1B:
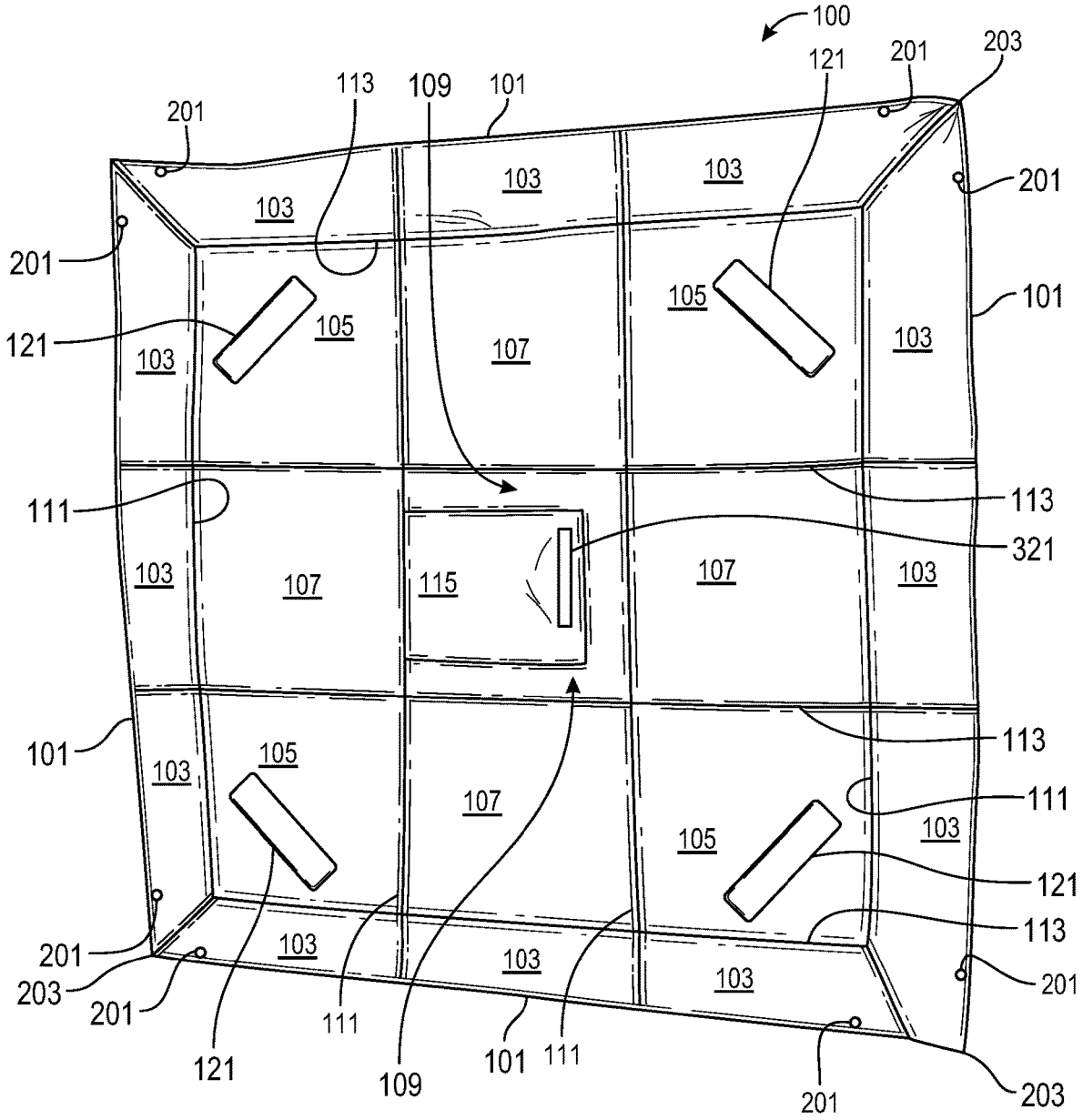
FIG. 1B may depict a mat from a top perspective view.
Figure 6:
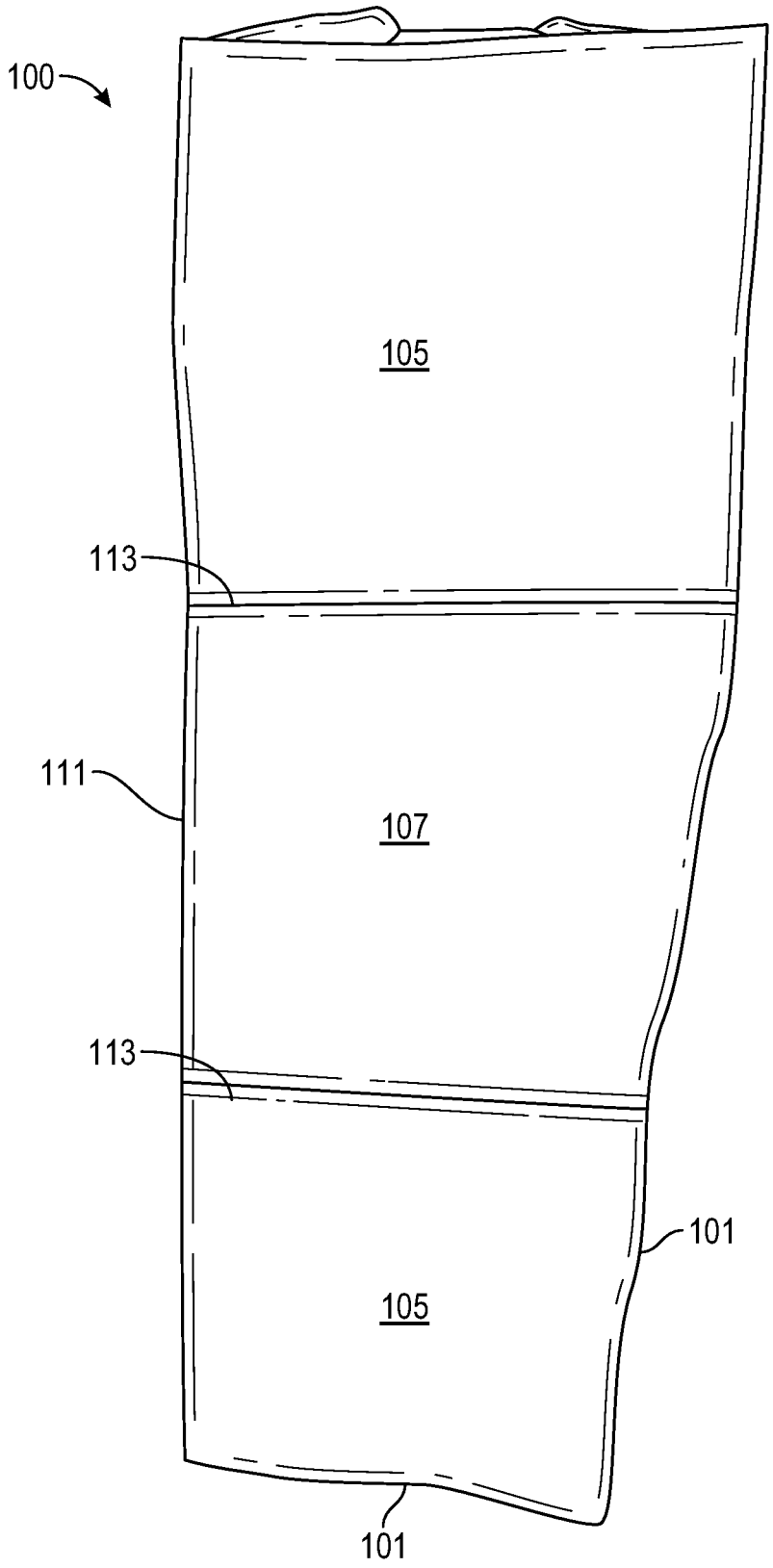
FIG. 6 may show the mat from FIG. A1, shown from a top perspective view, shown in a partially folded configuration.
Figure 7:
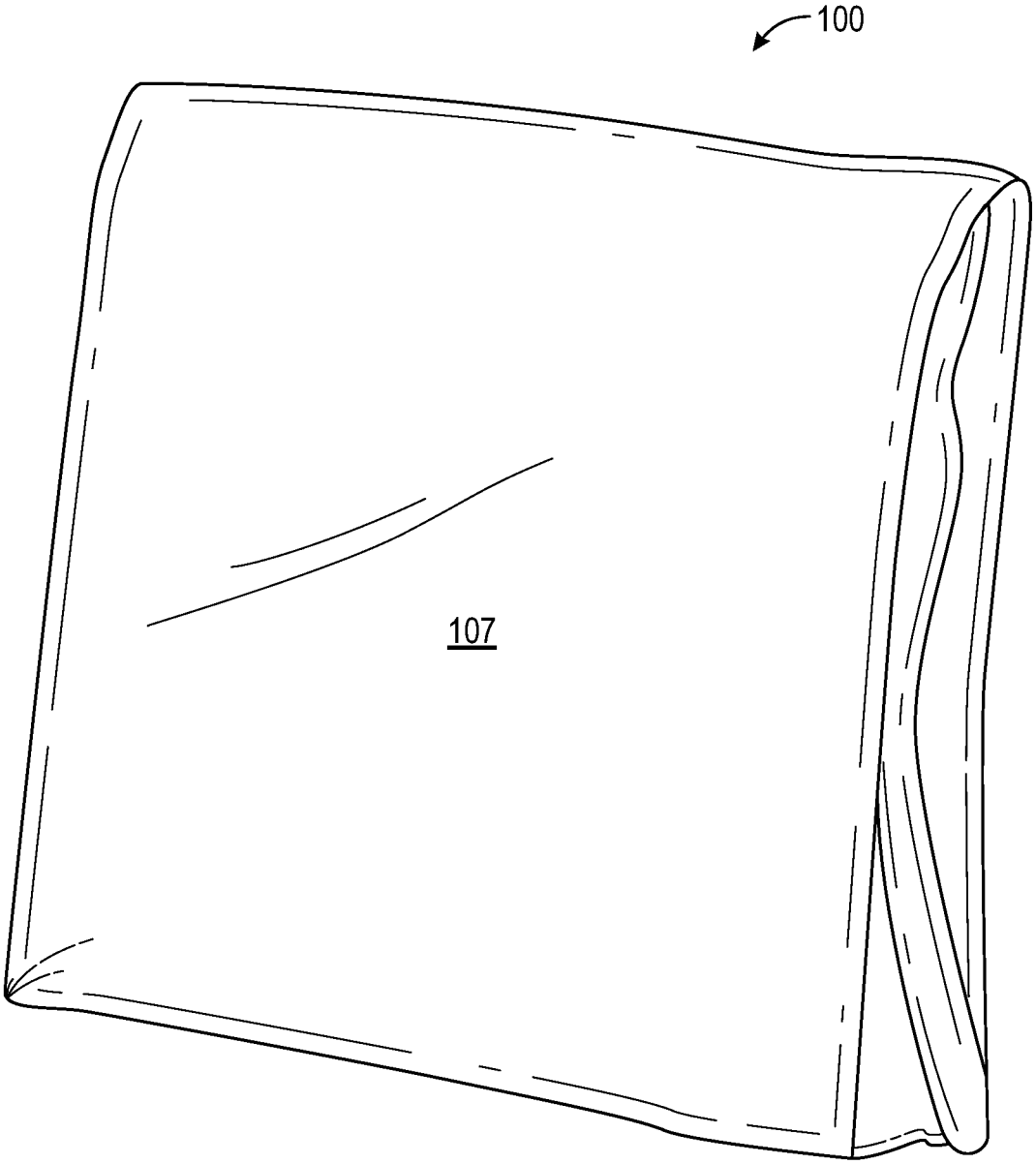
FIG. 7 may show the mat from FIG. 1A, shown from a top perspective view, shown in a fully folded configuration.
Figure 8:
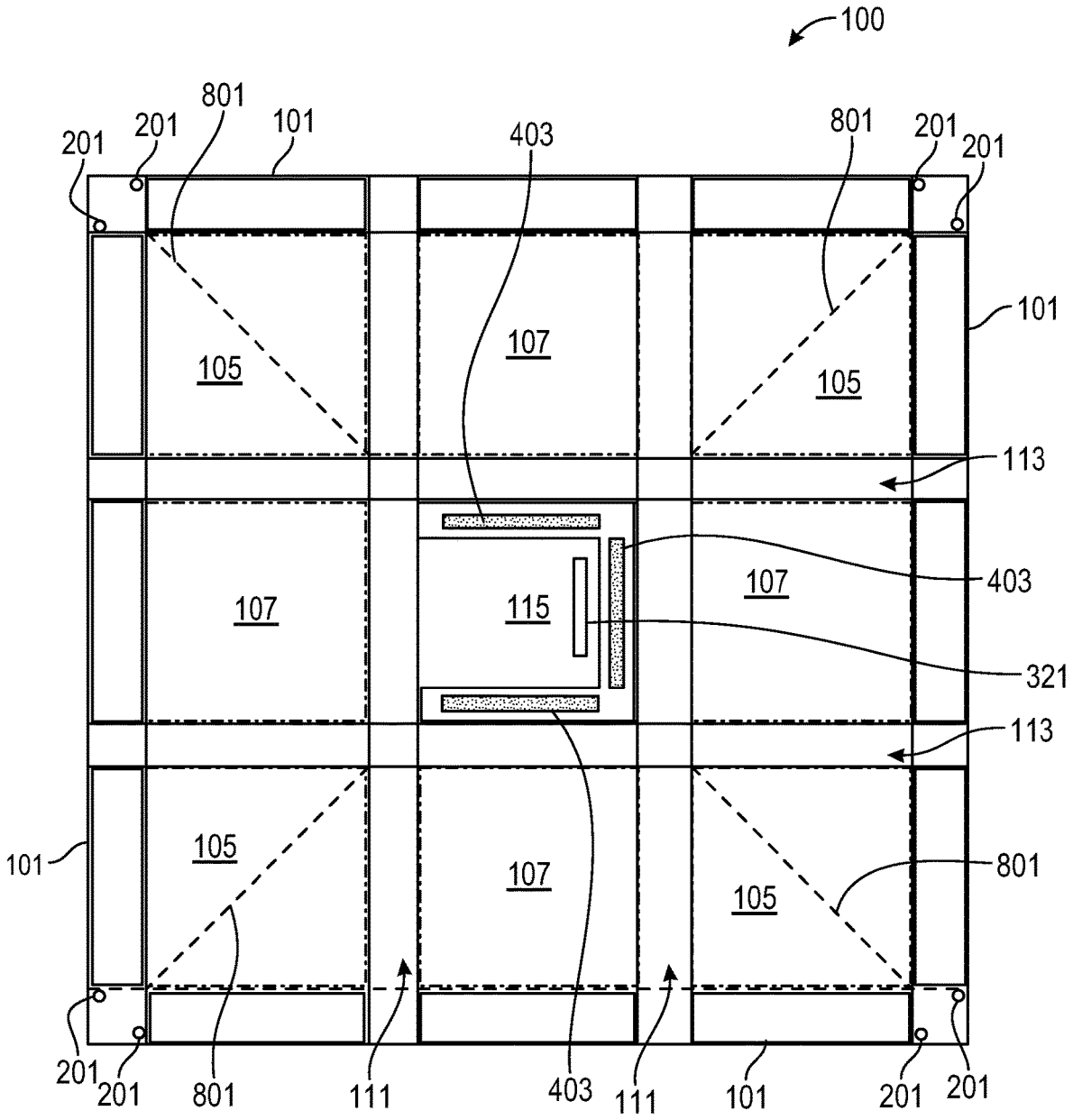
FIG. 8 may depict a top view schematic drawing of the mat from FIG. 1A.

In some embodiments, mat 100 may be transitioned into at least three different operational configurations: (1) a substantially flat work surface configuration; (2) a funnel like collection configuration; and (3) a folded configuration. FIG. 1A, FIG. 1B, and FIG. 8 may show mat 100 in the substantially flat work surface configuration. FIGS. 2A through 5 may mat 100 in the funnel like collection configuration. Also note the funnel like collection configuration may exist in two sub-configurations: a container/bag configuration (with trapdoor 115 closed, see e.g., FIG. 3); and a pure funnel configuration (with trapdoor 115 open, see e.g., FIG. 4 and FIG. 5). FIG. 7 may show mat 100 in its folded configuration; and FIG. 6 may show mat 100 in a partially folded configuration. FIG. 6 may show a transitory configuration on its way to the folded configuration or away from the folded configuration.

When mat 100 may be in its substantially flat work surface configuration, mat 100 may be used as a ground, a floor, a substrate, combinations thereof, and/or the like. When mat 100 may be in its substantially flat work surface configuration, mat 100 may be used as a play surface and/or as a work surface. Playing, gaming, building, crafting, working, combinations thereof, and/or the like with various hand sized articles or smaller may occur on top of mat 100 when mat 100 may be in its substantially flat work surface configuration. See e.g., FIG. 1A, FIG. 1B, and FIG. 8.

When it may be time to stop and clean-up from such working/playing activity on top of mat 100 in its substantially flat work surface configuration, mat 100 may be transitioned into its funnel like collection configuration (e.g., its container/bag configuration with trapdoor 115 closed) to quickly and efficiently collect those articles that may be on top of mat 100 and to funnel those articles into a single region (e.g., its pure funnel configuration with trapdoor 115 open). See e.g., FIGS. 2A through 5.

When it may be time to store mat 100, mat 100 may be transitioned into its folded configuration. See e.g., FIG. 7 and FIG. 6. In some embodiments, transitioning into the folded configuration may occur by folding of mat 100 (and unfolding may transition out of this folded configuration).

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1A may depict a mat 100 from a top perspective view. In FIG. 1A, mat 100 may be in its substantially flat work (play) surface configuration. From a top view, mat 100 while in this configuration may be substantially flat. From a top view, mat 100 while in this configuration may be substantially planar. From a top view, mat 100 while in this configuration may be substantially two-dimensional (2D). "Substantially" in this context denotes that mat 100 need not be geometrically perfectly flat, planar, and two-dimensional (2D), but rather, mostly flat, planar, and two dimensional in the configuration shown in FIG. 1A.

Continuing discussing FIG. 1A, in some embodiments, from a top view, when mat 100 may be in its substantially flat work configuration, mat 100 may appear substantially as a closed/bounded two-dimensional (2D) shape. In some embodiments, this closed two-dimensional shape may be a polygon. In some embodiments, this polygon may be a regular polygon. In some embodiments, this polygon may be irregular. In some embodiments, corners of this polygon may be rounded, not rounded, pointed, combinations thereof, and/or the like. In some embodiments, this polygon may be selected from: substantially squarish, substantially diamond shaped, substantially rectangular, substantially trapezoid shaped, substantially rhombus shaped, substantially quadrilateral shaped, substantially triangular shaped, substantially pentagon shaped, substantially hexagon shaped, substantially heptagon shaped, substantially octagon shaped, substantially star shaped, and/or the like. In some embodiments, this closed two-dimensional shape may be a circle, circular, oval, ovoid, elliptical, and/or the like.

Continuing discussing FIG. 1A, in some embodiments, mat 100 may be bounded around its peripheral edge by outer edges 101. In some embodiments, mat 100 may be bounded around its periphery by border 103. In some embodiments, border 103 may be located next to and immediately inside of outer edges 101. In some embodiments, border 103 may be an elongate portion, of a predetermined width, running around mat 100. In some embodiments, border 103 may be an elongate portion, of a predetermined width, running around panels of mat 100. In some embodiments, border 103 may be an elongate portion, of a predetermined width and fixed, running around mat 100. In some embodiments, border 103 may be an elongate portion, of a predetermined width, running along an inside of outer edges 101. In some embodiments, border 103 may be an elongate portion, of a predetermined width and fixed, running along an inside of outer edges 101. In some embodiments, towards an outside of mat 100, border 103 may end at outer edge 101. In some embodiments, towards an inside of mat 100, border 103 may end at one or more panels. In some embodiments, such panels may be of two different types, corner panels 105 and side panels 107. In some embodiments, such panels may be of three different types, corner panels 105, side panels 107, and at least one central/middle panel 109 (with trapdoor 115).

Continuing discussing FIG. 1A, in some embodiments, inside portions of mat 100 may be substantially formed from a plurality of interconnected panels. In some embodiments, this plurality of interconnected panels may be bounded by outer edges 101 or border 103. In some embodiments, this plurality of interconnected panels may be arranged in a predetermined substantially two-dimensional (2D) pattern, when viewed from above. In some embodiments, this predetermined substantially two-dimensional (2D) pattern may be a two by two configuration of panels; a three by three configuration of panels, a four by four configuration of panels, or a five by five configuration of panels. In some embodiments, the plurality of interconnected panels may be a matrix of at least nine panels; e.g., arranged in a three by three matrix of panels. In some embodiments, this plurality of interconnected panels may be of three different types of panels: corner panels 105, side panels 107, and panel-for-door 109. In some embodiments, corner panels 105 may be located proximate to each corner 203 (i.e., each main outer corner 203) of mat 100. In some embodiments, mat 100 may have four corner panels 105. In some embodiments, side panels 107 may be located between two different corner panels 105. In some embodiments, mat 100 may have four side panels 107. In some embodiments, corner panels 105 and side panels 107 may be at least eight panels. In some embodiments, mat 100 may have one (or at least one) panel-for-door 109. In some embodiments, panel-for-door 109 may also be known as at least one central panel 109. In some embodiments, the at least eight panels (e.g., corner panels 105 and side panels 107) may be disposed around the at least one central panel 109. In some embodiments, panel-for-door 109 may be substantially centrally (middle) located in mat 100, as viewed from above. In some embodiments, panel-for-door 109 may be bound orthogonally by side panels 107 and diagonally by corner panels 105. In some embodiments, panels (e.g., panel 105, panel 107, and/or panel 109) of mat 100 may be bound by border 103; and border 103 may be bound by outer edge 101. See e.g., FIG. 1A.

Continuing discussing FIG. 1A, in some embodiments, each panel (e.g., corner panels 105, side panels 107, and/or panel-for-door 109) selected from the plurality of interconnected panels may be substantially shaped as a square, a rectangle, a triangle, and/or the like, when viewed from above. In some embodiments, each corner panel 105 may be formed from two triangles (e.g., two equal right triangles joined along a common hypotenuse) that when are unfolded substantially from a square shape for that given corner panel 105, when viewed from above. In some embodiments, the two triangles may be two (equally sized) right triangles, with their respective hypotenuse substantially parallel along a shared fold line (such as fold line 801 shown in FIG. 8). In some embodiments, the two triangles may be two right triangles, with their respective hypotenuse in communication with each other. See e.g., fold line 801 in FIG. 8.

Continuing discussing FIG. 1A, in some embodiments, each panel (e.g., corner panels 105, side panels 107, and/or panel-for-door 109) selected from the plurality of interconnected panels may be operatively coupled to at least two other panels selected from the plurality of interconnected panels. In some embodiments, this operative coupling may provide for flexing and/or bending between such panels. In some embodiments, this flexing and/or bending between panels (e.g., corner panels 105, side panels 107, and/or panel-for-door 109) may be provided by elongate portions of flex strip 111 and/or bend strip 113. In some embodiments, flex strip 111 and/or bend strip 113 may be substantially linear (e.g., substantially colinear, when not folded). In some embodiments, flex strip 111 and/or bend strip 113 may demarcate between panels of the plurality interconnected panels. In some embodiments, flex strip 111 and/or bend strip 113 may permit flexing, bending, and/or folding between panels of the plurality interconnected panels. In some embodiments, flex strip 111 and/or bend strip 113 may be a hinge between adjacent panels. In some embodiments, flex strip 111 and/or bend strip 113 may function as a hinge between adjacent panels. In some embodiments, flex strip 111 and/or bend strip 113 may be a living hinge and/or function as a living hinge. In some embodiments, flex strip 111 and/or bend strip 113 may be substantially constructed from fabric, elastomer, flexible plastic, combinations thereof, and/or the like. In some embodiments, flex strip 111 may run orthogonal to bend strip 113. For example, and without limiting the scope of the present invention, if bend strip 113 runs along an artificial/hypothetical x-axis direction mat 100, then flex strip 111 would run along an artificial/hypothetical y-axis direction of mat 100. In some embodiments, mat 100 may comprise at least a parallel set of flex strips 111, separated from each other by panels. In some embodiments, mat 100 may comprise at least a parallel set of bend strips 113, separated from each other by panels. See e.g., FIG. 1A.

Continuing discussing FIG. 1A, in some embodiments, panel-for-door 109 may comprise at least one openable and closeable trapdoor 115. In some embodiments, located in panel-for-door 109 may be trapdoor 115. In some embodiments, trapdoor 115 may openable and closeable with respect to panel-for-door 109. In some embodiments, along three edges of trapdoor 115 may be one or more fasteners 403 that may removably couple to complimentary fasteners along an opening in panel-for-door 109. In some embodiments, these fasteners 403 and complimentary fasteners may be mechanical fasteners. In some embodiments, these mechanical fasteners may be one or more of: zippers, buttons, snaps, ties, plurality of hooks and plurality of loops (such as VELCRO or the like), magnets, magnetic materials, magnet and material attracted to magnets, combinations thereof, and/or the like. In some embodiments, trapdoor 115 may be openable from a closed configuration to panel-for-door 109 by pulling with at least one hand on trapdoor 115. In some embodiments, trapdoor 115 may function as a trapdoor. In some embodiments, trapdoor 115 may provide a means for emptying mat 100 of articles collected within mat 100 when mat 100 may be in its funnel like collection configuration. See e.g., FIG. 1A, FIG. 3, FIG. 4, and FIG. 5.

Continuing discussing FIG. 1A, in some embodiments, mat 100 may comprise at least one strap 117. In some embodiments, mat 100 may comprise at least two straps 117. In some embodiments, two straps 117 of mat 100 may be arranged substantially orthogonally from each other (with respect to each other). In some embodiments, a given strap 117 may be an elongate member. In some embodiments, a given strap 117 may be flexible and/or bendable. In some embodiments, a given strap 117 may be non-stretchable. In some embodiments, a given strap 117 may be stretchable. In some embodiments, opposing terminal ends of a given strap 117 may be attached at or proximate to opposing corners of mat 100. In some embodiments, opposing terminal ends of a given strap 117 may be attached at or proximate to opposing corner panels 105 of mat 100. In some embodiments, opposing terminal ends of a given strap 117 may be permanently attached at or proximate to opposing corners of mat 100. In some embodiments, opposing terminal ends of a given strap 117 may be removably attached at or proximate to opposing corners of mat 100. In some embodiments, strap(s) 117 may be detached from mat 100. In some embodiments, attachment of strap 117 to mat 100 may be accomplished by one or more of: mechanical fasteners, Velcro (or Velcro like), snaps, buttons, zippers, ties, sewn seams, glue, chemical adhesive, welding, heat welding, solvent bonding, ultrasonic welding, combinations thereof, and/or the like—some forms of attachment may be intended to be removable, whiles others may be intended to be permanent. In some embodiments, middle regions of straps 117 may not be attached to anything. In some embodiments, when 100 may be in its substantially flat configuration, strap(s) 117 may lay flat on top of mat 100. In some embodiments, lifting of straps 117 upwards away from a top surface of mat 100 may cause mat 100 to transition from its substantially flat work surface configuration (shown in FIG. 1A) to its funnel like configuration (see e.g., FIG. 3).

Continuing discussing FIG. 1A, in some embodiments, mat 100 may comprise at least one handle 121. In some embodiments, a given handle 121 may be an elongate member with opposing terminal ends. In some embodiments, the opposing terminal ends of a given handle 121 may be attached to a top/upper surface/portion of mat 100. In some embodiments, the opposing terminal ends of a given handle 121 may be attached to a top/upper surface/portion of a panel of mat 100. In some embodiments, the opposing terminal ends of a given handle 121 may be attached to a top/upper surface/portion of a side panel 107 of mat 100. In some embodiments, handle 121 may be removably and/or permanently attached to mat 100. In some embodiments, attachment of handle 121 to mat 100 may be accomplished by one or more of: mechanical fasteners, Velcro (or Velcro like), snaps, buttons, zippers, ties, sewn seams, glue, chemical adhesive, welding, heat welding, solvent bonding, ultrasonic welding, combinations thereof, and/or the like—some forms of attachment may be intended to be removable, whiles others may be intended to be permanent. In some embodiments, when 100 may be in its substantially flat configuration, handle(s) 121 may lay flat on top of mat 100. In some embodiments, a middle portion/region of a given handle 121 may not be attached to anything (e.g., not to mat 100). In some embodiments, handle 121 may be configured to be gripped by a human hand. In some embodiments, a given handle 121 may be shorter than a given strap 117. In some embodiments, a length of handle 121 in a given side panel 105 may run substantially parallel with respect to a closest outer edge 101, when mat 100 may be in the substantially flat work surface configuration. See e.g., FIG. 1A.

In some embodiments, a given handle 121 may run in a direction that is not parallel nor perpendicular with a direction of a given strap 117. In some embodiments, a given handle 121 may run in a direction that is substantially 45 degrees with a direction of a given strap 117. See e.g., FIG. 1A. In some embodiments, a given mat 100 may have no handles 121.

Continuing discussing FIG. 1A, in some embodiments, mat 100 may comprise outer edges 101, border 103, corner panels 105, side panels 107, panel-for-door 109, flex strip 111, bend strip 113, trapdoor 115, strap(s) 117, and handle(s) 121, wherein these components may be as described above.

FIG. 1B may depict an embodiment of mat 100 from a top perspective view, wherein straps 117 may be replaced with handles 121. In some embodiments, each corner panel 105 have attached to an upper surface a given handle 121. In some embodiments, a length of handle 121 in a given corner panel 105 may run substantially orthogonal with respect an imaginary diagonal line running between opposing corners 203, when mat 100 may be in the substantially flat work surface configuration. In this embodiment shown in FIG. 1B, mat 100 may transitioned from the substantially flat work surface configuration to the funnel like configuration by the user raising the four handles 121 upwards away from panel-for-door 109, instead of raising up the two straps 117 upwards away from panel-for-door 109 as may be the case for mat 100 shown in FIG. 1A.

In some embodiments, a given mat 100 may have: straps 117 and no handles 121 (see e.g., FIG. 1A but mat 100 would have no handles 121); straps 117 and handles 121 (see e.g., FIG. 1A); or no straps 117 but with handles 121 (see e.g., FIG. 1B).

Figure 2A:
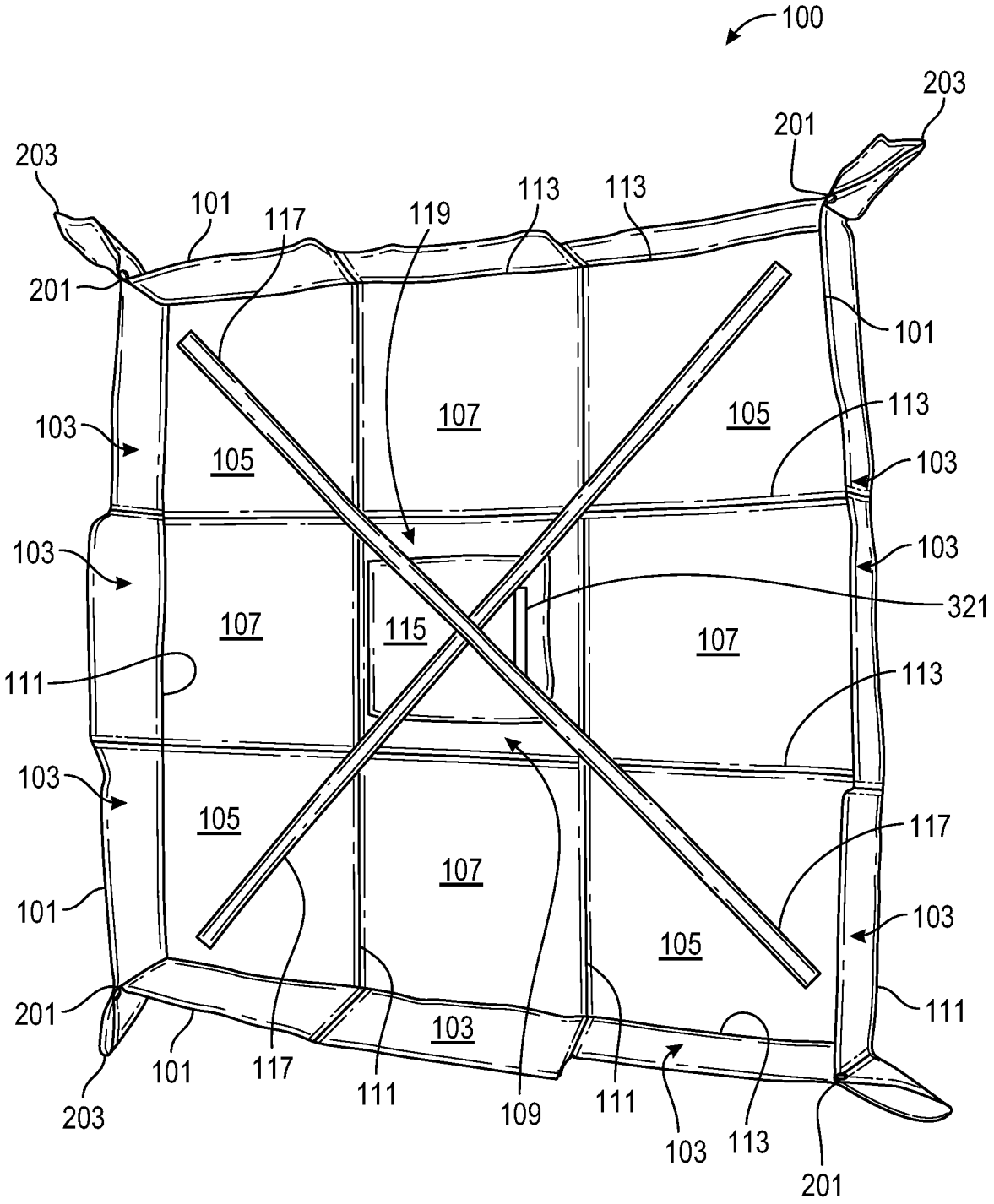
FIG. 2A may depict the mat from FIG. 1A, shown from a top perspective view, but with outer borders configured into a substantially vertical barrier.

FIG. 2A may depict mat 100, shown from a top perspective view, but with outer border 103 configured into a substantially vertical barrier, wherein panels (e.g., corner panels 105, side panels 107, and/or panel-for-door 109) of mat 100 may be still substantially in a shared horizontal (flat) plane; and outer border 103 may now be substantially vertical (orthogonal) to this shared horizontal plane. When border 103 may be in this substantially raised vertical orientation, border 103 may act as a physical wall or fence of mat 100 for the panels (e.g., corner panels 105, side panels 107, and/or panel-for-door 109) of mat 100. When border 103 may be in this substantially raised vertical orientation, border 103 may act as a raised physical barrier for mat 100 (for the panels of mat 100). Placing border 103 into this substantially raised vertical orientation may help to facilitate placing mat 100 into its funnel like configuration, by helping to minimize articles on top of mat 100 from falling off of mat 100. To place mat 100 into this configuration shown in FIG. 2A, with border 103 into this substantially raised vertical orientation, adjacent sides of each corner 203 of mat 100 may be removably attached to each other by fasteners 201. In some embodiments, each adjacent side of a corner 203 of mat 100 may comprise at least one fastener 201. In some embodiments, fasteners 201 may be mechanical fasteners. In some embodiments, these mechanical fasteners may be one or more of: buttons, snaps, ties, plurality of hooks and plurality of loops (such as VELCRO or the like), magnets, magnetic materials, magnet and material attracted to magnets, combinations thereof, and/or the like. In some embodiments, mat 100 may comprise fasteners 201. In some embodiments, mat 100 may comprise a pair of complimentary fasteners 201 for each corner 203 of mat 100.

In some embodiments, borders 103 may be bent/folded upwards into the vertically raised configuration shown in FIG. 2A (and shown in FIG. 2B) by folding/bending along flex strip 111 and/or bend strip 113 between borders 103 and an adjacent panel; and with complimentary adjacent paired fasteners 201 removably connected to each other. See e.g., FIG. 1A and FIG. 2A.

Figure 2B:
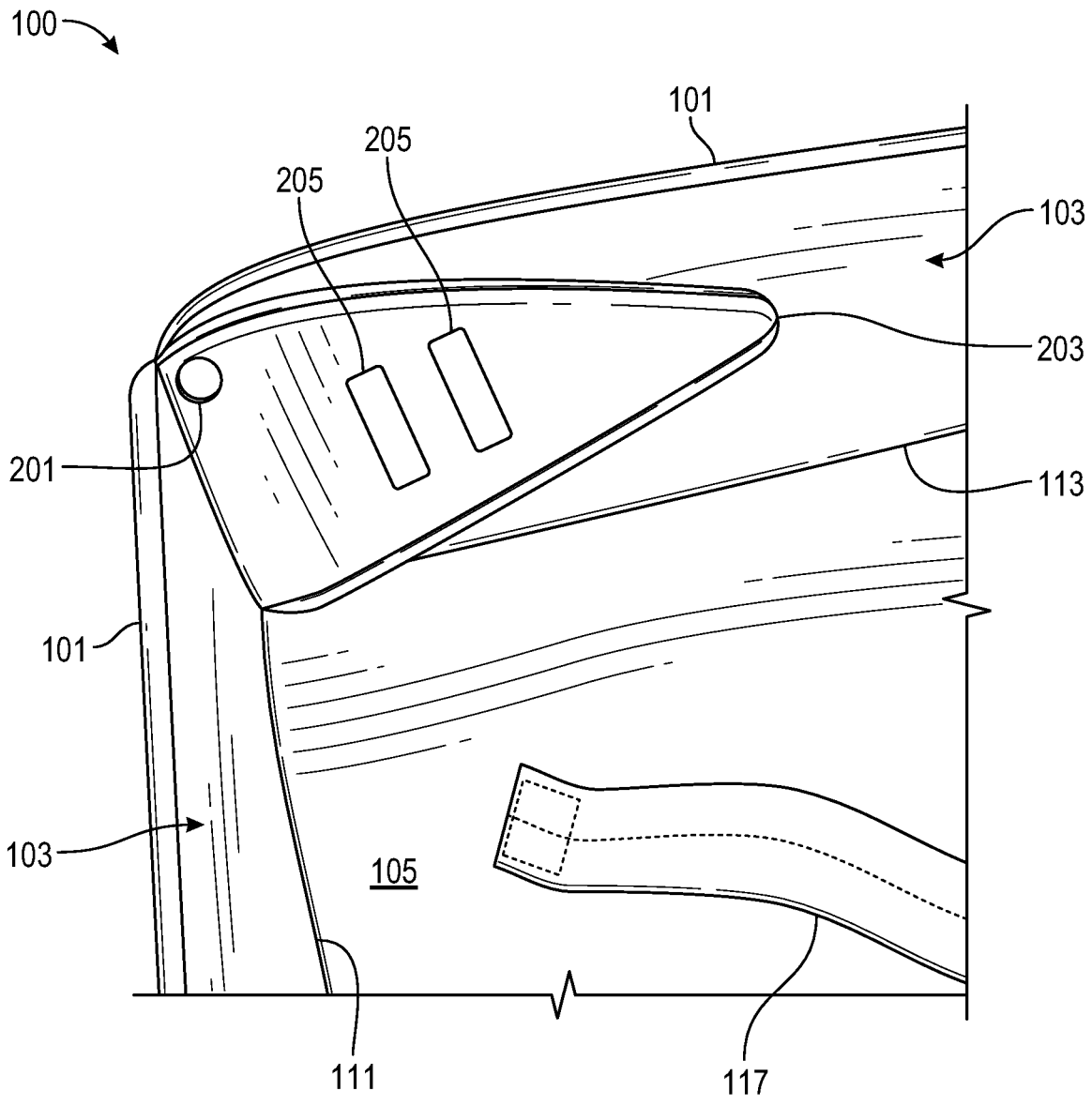
FIG. 2B may depict a corner region (e.g., an upper left) of a mat, showing that in some embodiments a given corner may protrude inwards instead of outwards as is shown in FIG. 2A.

FIG. 2B may depict a corner region (e.g., an upper left corner region) of mat 100, showing that in some embodiments a given corner 203 may protrude inwards instead of outwards as is shown in FIG. 2A. FIG. 2B may depict detail of the upper left corner region of FIG. 2A, except in FIG. 2B, corner 203 may protrude inwards instead of outwards. In FIG. 2A, the four corners 203 of mat 100 may protrude outwards, when adjacent/proximate/paired/complimentary fasteners 201 may be connected to each other. Whereas, as shown in FIG. 2B, in some embodiments, one or more of the corners 203 may also be arranged to protrude inwards when adjacent/proximate fasteners 201 may be connected to each other. In some embodiments, when adjacent/proximate/paired/complimentary fasteners 201 may be connected to each other corner(s) 203 may protrude inwards or outwards. See e.g., FIG. 2A and FIG. 2B.

Continuing discussing FIG. 2B, in some embodiments, proximate to each corner 203 (e.g., within two inches of a corner 203 tip) may be one or two fasteners 205. In some embodiments, fasteners 205 may be mechanical fasteners. In some embodiments, these mechanical fasteners may be one or more of: buttons, snaps, ties, plurality of hooks and plurality of loops (such as VELCRO or the like), magnets, magnetic materials, magnet and material attracted to magnets, combinations thereof, and/or the like. In some embodiments, mat 100 may comprise fasteners 205.

Figure 3:
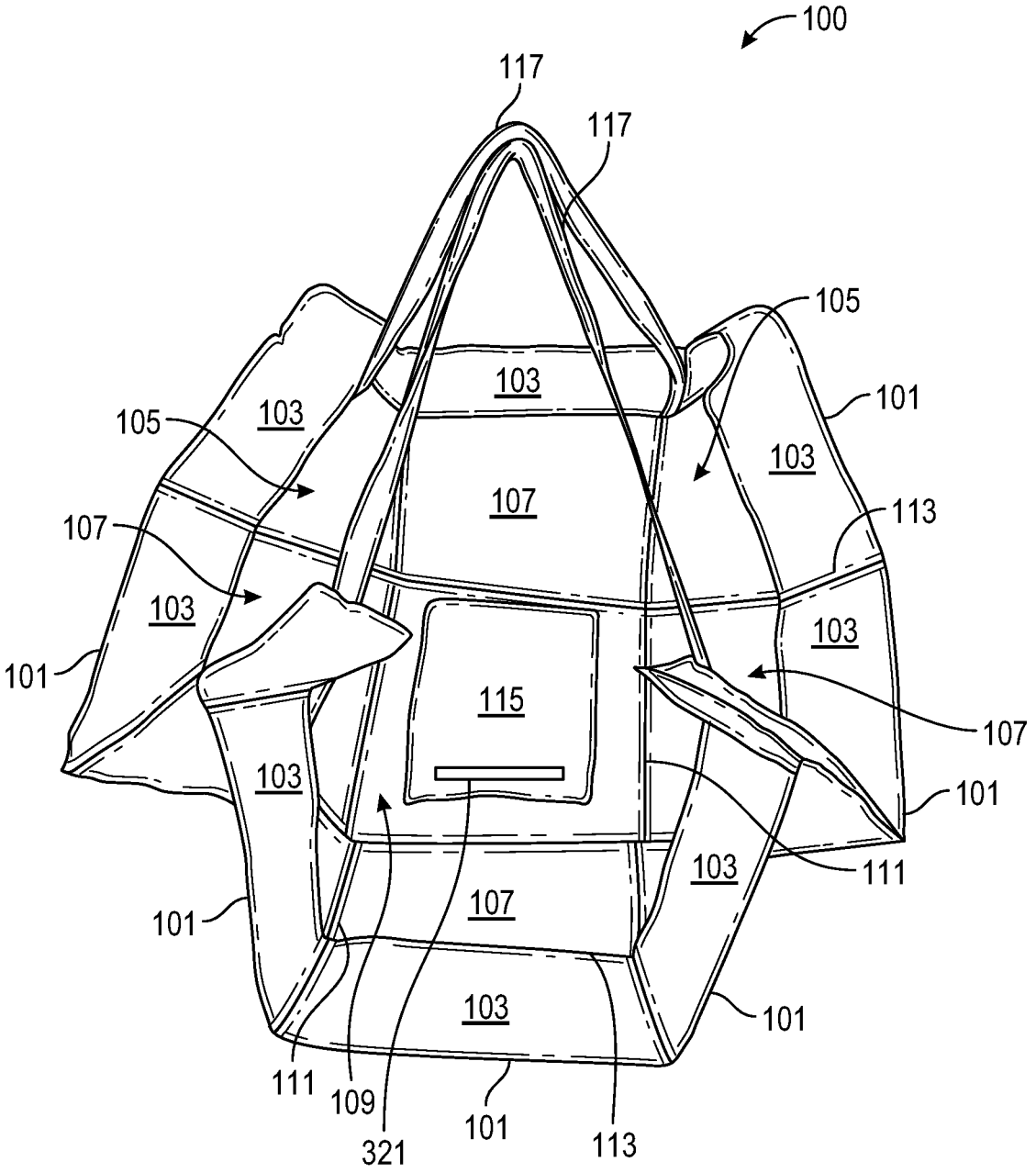
FIG. 3 may depict the mat from FIG. 1A, shown from a top perspective view, with straps of the mat in a process of being lifted upwards such that the mat functions substantially as a funnel.

FIG. 3 may depict mat 100, shown from a top perspective view, with straps 117 of mat 100 in a process of being lifted upwards (away from panel-for-door 109) such that mat 100 functions substantially as a funnel. In FIG. 3, trapdoor 115 may be still be closed and removably fastened to panel-for-door 109. FIG. 3 may show mat 100 in its container/bag configuration with trapdoor 115 closed. In this container/bag configuration with trapdoor 115 closed, the middles of strap(s) 117 may be a highest point of mat 100 and panel-for-door 109 (with closed trapdoor 115) may be at a lowest point of mat 100, with panel-for-door 109 (with closed trapdoor 115) disposed directly beneath the middles of strap(s) 117. Articles on top of mat 100 and within mat 100's boundaries may be funneled towards trapdoor 115 and/or panel-for-door 109, when mat 100 may be in this funnel like collection configuration (container/bag configuration). Articles on top of mat 100 and within mat 100's boundaries may collect on top of trapdoor 115 and/or panel-for-door 109, when mat 100 may be in this funnel like collection configuration (container/bag configuration). Thus, by lifting straps 117 upwards, clean-up may occur very quickly and efficiently with respect to loose articles located on top of mat 100 when mat 100 was in its substantially flat configuration.

Continuing discussing FIG. 3, in some embodiments, trapdoor 115 may comprise at least one handle 321. In some embodiments, at least one handle 321 may be located away from the hinge region of trapdoor 115. In some embodiments, at least one handle 321 may be an elongate member. In some embodiments, at least one handle 321 may be substantially constructed from at least one fabric. In some embodiments, at least one handle 321 may be substantially webbing and/or strapping.

Figure 4:
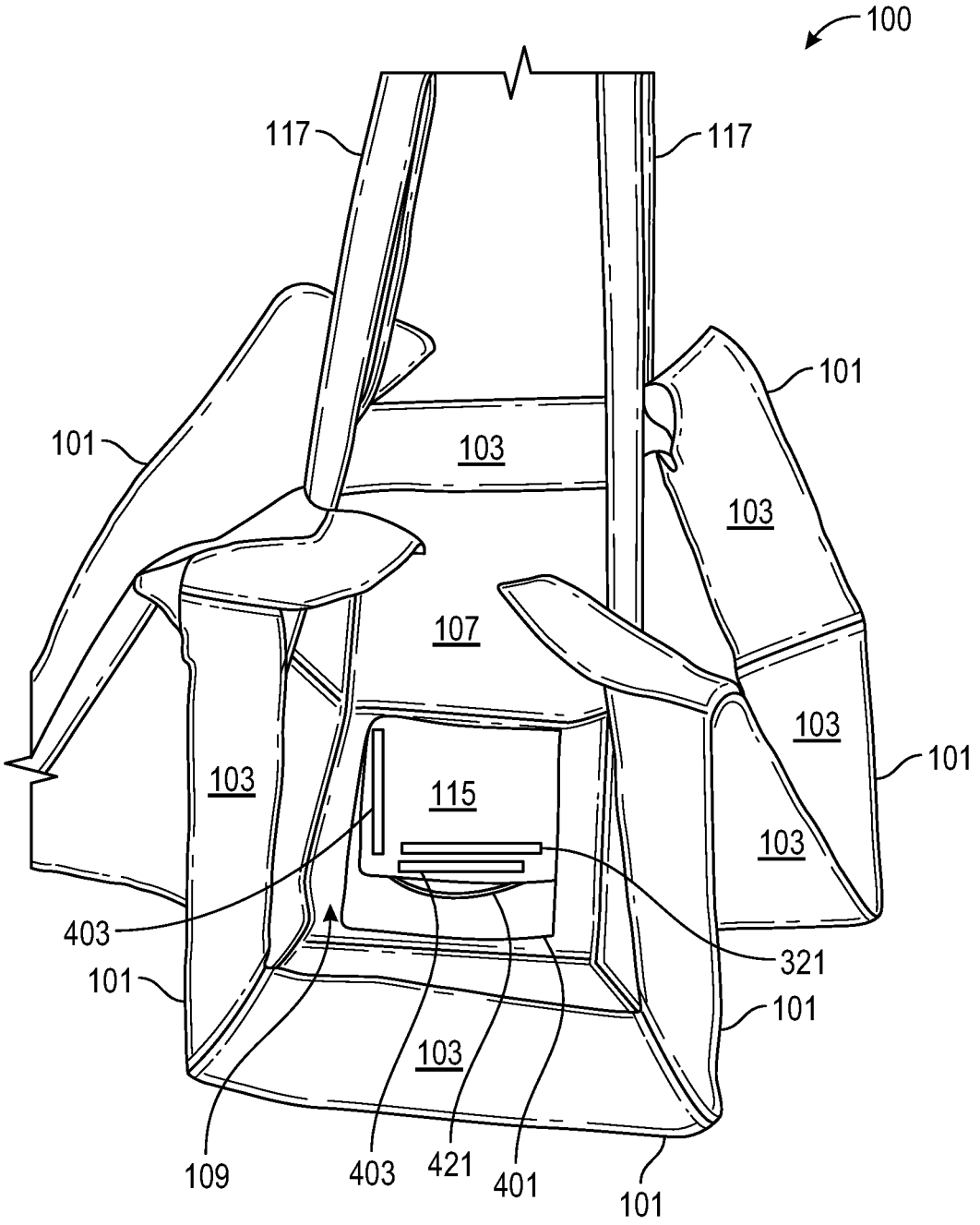
FIG. 4 may depict the mat from FIG. 1A, shown from a top perspective view, with straps of the mat lifted upwards, such that the mat is in its funnel configuration and shown with a trapdoor of the mat open.

FIG. 4 may depict mat 100, shown from a top perspective view, with straps 117 of mat 100 lifted upwards, such that mat 100 may be in its funnel configuration and shown with trapdoor 115 of mat 100 open. In FIG. 4, door-opening 401 may be seen. In some embodiments, door-opening 401 may be an opening through panel-for-door 109. In some embodiments, door-opening 401 may be located in panel-for-door 109. In some embodiments, when trapdoor 115 may be open, articles may then drain out and/or be readily emptied (e.g., by gravity) through door-opening 401. Such articles may be fed directly into an awaiting receiving bin, hopper, and/or the like (not shown) from mat 100, when mat 100 may be in its funnel like configuration with trapdoor 115 open. In some embodiments, trapdoor 115 may be removably sealable (attached to and/or fastened to) to a bottom of panel-for-door 109, along and/or proximate to door-opening 401. Such removable sealing may be accomplished with fasteners 403 located along and/or proximate to edges of trapdoor 115; as well as complimentary fasteners located on panel-for-door 109. In some embodiments, fasteners 403 and its complimentary fasteners on panel-for-door 109 may be mechanical fasteners. In some embodiments, these mechanical fasteners may be one or more of: zippers, buttons, snaps, ties, plurality of hooks and plurality of loops (such as VELCRO or the like), magnets, magnetic materials, magnet and material attracted to magnets, combinations thereof, and/or the like. In some embodiments, mat 100 may comprise fasteners 403 and its complimentary fasteners on panel-for-door 109.

Continuing discussing FIG. 4, in some embodiments, trapdoor 115 may comprise at least one handle 421. In some embodiments, at least one handle 421 may be located away from the hinge region of trapdoor 115. In some embodiments, at least one handle 421 may be located on a bottom of trapdoor 115. In some embodiments, at least one handle 421 may be an elongate member. In some embodiments, at least one handle 421 may be substantially constructed from at least one fabric. In some embodiments, at least one handle 421 may be substantially webbing and/or strapping.

Figure 5:
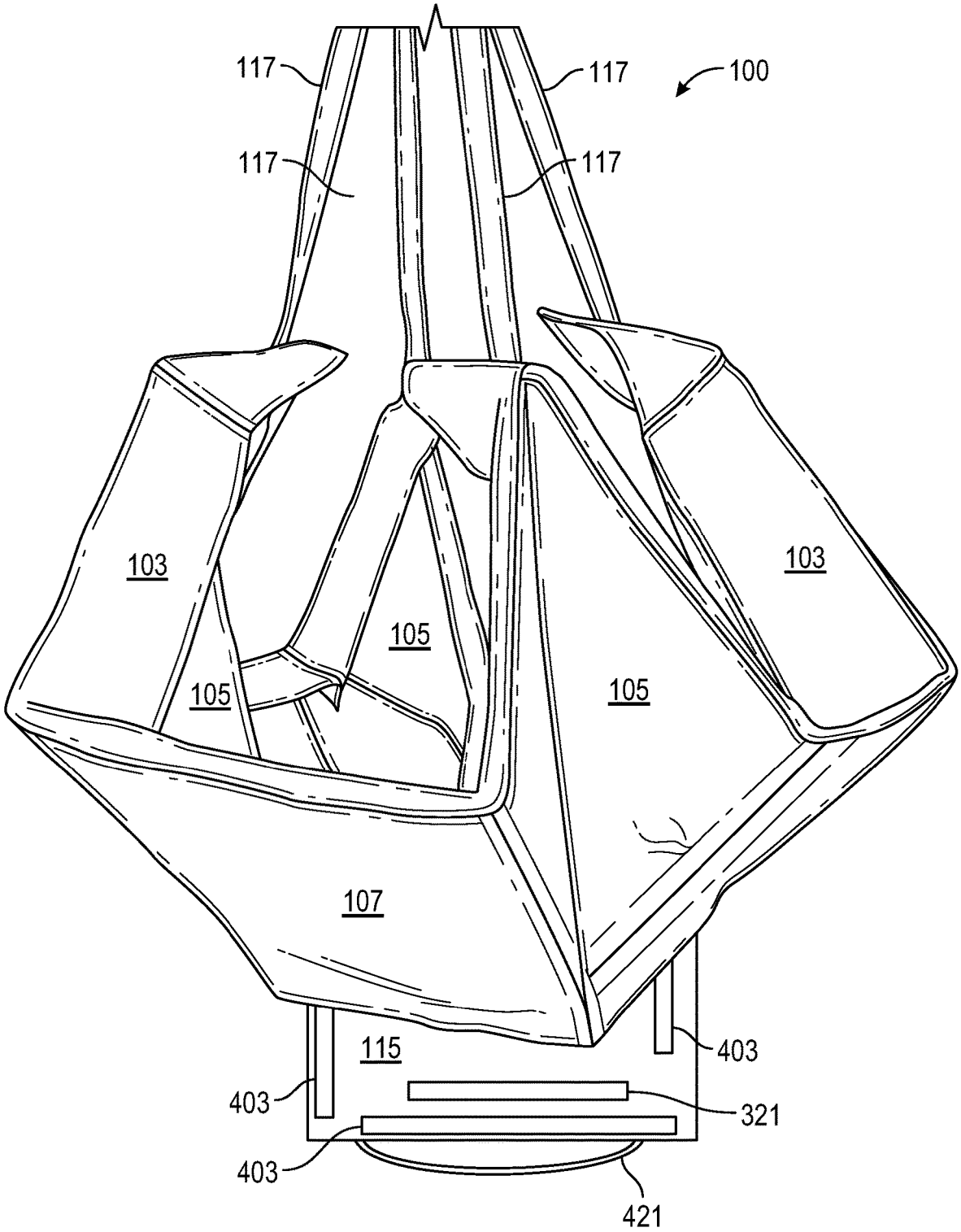
FIG. 5 may depict the mat from FIG. 1A, shown from a side perspective view, with straps of the mat lifted upwards, such that the mat is in its funnel configuration and shown with a trapdoor of the mat open.

FIG. 5 may depict mat 100, shown from a side perspective view, with straps 117 of mat 100 lifted upwards, such that mat 100 is in its funnel configuration and shown with trapdoor 115 of mat 100 open.

FIG. 6 may show mat 100, shown from a top perspective view, shown in a partially folded configuration. In some embodiments, mat 100 may be folded along flex strip 111, bend strip 113, and/or fold lines 801. Such folding may allow mat 100 to be folded into various shapes, with smaller footprints for efficient storage of mat 100. For example, and without limiting the scope of the present invention, mat 100 may be folded into various substantially shaped polygon shapes, when viewed from above, such as, but not limited to, rectangles, squares, triangles, and the like.

FIG. 7 may show mat 100, shown from a top perspective view, shown in a fully folded configuration.

FIG. 8 may depict a top view schematic drawing of mat 100. Note any broken line (dotted line) shown in FIG. 8 may be a fold line, such as fold line 801.

In some embodiments, mat 100 may be mat for facilitating clean-up. In some embodiments, mat 100 may comprise a plurality of interconnected panels and at least two straps 117. In some embodiments, mat 100 may be transitional into at least one of three main configurations: the substantially flat work surface configuration, the funnel like collection configuration, and the folded configuration. In some embodiments, when mat 100 may be in the substantially flat work surface configuration, mat 100 may be substantially flat and substantially planar. See e.g., FIG. 1A, FIG. 1B, and FIG. 8. In some embodiments, when mat 100 may be in the funnel like collection configuration, a middle region of the at least two straps 117 may be configured to be located at a highest location of the mat and the at least one trapdoor 115 may be configured to be located at a lowest location of the mat. See e.g., FIG. 3, FIG. 4, and FIG. 5. In some embodiments, when mat 100 may be in the folded configuration, the plurality of interconnected panels are stacked on top of each other. See e.g., FIG. 7.

In some embodiments, the plurality of interconnected panels (e.g., corner panels 105, side panels 107, and panel-for-door 109) may comprise at least one central panel 109 and at least eight panels (e.g., corner panels 105 and side panels 107) disposed around the at least one central panel 109. In some embodiments, the at least one central panel 109 may comprise at least one trapdoor 115. In some embodiments, the at least one trapdoor 115 may be removably openable and closeable. In some embodiments, at least one trapdoor 115 may open downwards beneath the at least one central panel 109. In some embodiments, each panel selected from the plurality of interconnected panels (e.g., corner panels 105, side panels 107, and panel-for-door 109) may be attached to at least two adjacent panels selected from the plurality of interconnected panels. In some embodiments, this attachment between each panel selected from the plurality of interconnected panels and the at least two adjacent panels selected from the plurality of interconnected panels may be by at least one flex strip 111 and by at least one bend strip 113. In some embodiments, at least one flex strip 111 may function as a hinge; wherein at least one bend strip 113 may function as a different hinge. In some embodiments, at least one flex strip 111 and at least one bend strip 113 may be substantially orthogonal with respect to each other, when mat 100 may be in the substantially flat work surface configuration. In some embodiments, at least one flex strip 111 and at least one bend strip 113 may be substantially linear, when mat 100 may be in the substantially flat work surface configuration. In some embodiments, each panel selected from the plurality of interconnected panels may be substantially flat and substantially planar. In some embodiments, each panel selected from the plurality of interconnected panels may be at least semi-rigid to rigid. In some embodiments, each panel selected from the plurality of interconnected panels may be substantially covered in at least one fabric. In some embodiments, the at least eight panels, selected from the plurality of interconnected panels, may comprise four corner panels 105 and four side panels 107. In some embodiments, the four corner panels 105 may be located towards corners 203 of mat 100. In some embodiments, disposed between two of the four corner panels 105 may be one of the four side panels 107. In some embodiments, at least one panel selected from the plurality of interconnected panels may comprise at least one handle 121 attached to an upper surface of that at least one panel. See e.g., FIG. 1A and FIG. 1B.

In some embodiments, each strap 117 selected from the at least two straps 117 may be an elongate member that may comprise two opposing terminal ends. In some embodiments, all the opposing terminal ends of the at least two straps 117 may be attached to different upper portions of mat 100. In some embodiments, each of the opposing terminal ends of the at least two straps 117 may be attached to one of the four corner panels 105, such that the at least two straps 117 may be substantially orthogonal to each other when mat 100 may be in the substantially flat work surface configuration. In some embodiments, when mat 100 may be in the substantially flat work surface configuration, the at least two straps 117 may lay substantially flat upon at least some of the panels selected from the plurality of interconnected panels. In some embodiments, each strap 117 selected from the at least two straps 117 may be longer than three panels, selected from the plurality of interconnected panels, wherein the three panels are with respect to those three panels arranged linearly end to end (e.g., a corner panel 105, then a side panel 107, and then another corner panel 105). See e.g., FIG. 1A.

In some embodiments, mat 100 may further comprise border 103. In some embodiments, border 103 may be located along an outside peripheral edge of the plurality of interconnected panels, such that the plurality of interconnected panels may be bound within border 103. In some embodiments, border 103 may comprise a fixed and a predetermined width that runs around the outside peripheral edge of the plurality of interconnected panels. In some embodiments, border 103 may comprise a fixed, a non-variable, and a predetermined width that runs around the outside peripheral edge of the plurality of interconnected panels. See e.g., FIG. 1A and FIG. 1B.

In some embodiments, when mat 100 may be in the substantially flat work surface configuration, mat 100 when viewed from above, may have a polygon shape. In some embodiments, proximate to each corner 203 of that polygon shape, may be a pair of complimentary fasteners 201 that may be configured to removably attach to each other. See e.g., FIG. 1A, FIG. 1B, and FIG. 2A. In some embodiments, when all of the pairs of complimentary fasteners 201 may be removably attached to each other, border 103 may fold into planes that may be substantially orthogonal with respect to a common plane of the plurality of interconnected panels, when the plurality of interconnected panels are substantially flat and planar. See e.g., FIG. 1A, FIG. 1B, and FIG. 2A.

In some embodiments, border 103 may comprise outer edge 101 that may define a boundary of mat 100. In some embodiments, disposed opposite of outer edge 101, by a width of border 103, may be where border 103 attaches to the plurality of interconnected panels. See e.g., FIG. 1A and FIG. 1B. In some embodiments, wherein at or proximate to outer edge 101 may be a plurality of fasteners 201. In some embodiments, fasteners 201 may be located at particular and predetermined locations. In some embodiments, fasteners 201 may be located at particular and predetermined locations, to facilitate bending/folding up of border 103 to form a fence around the plurality of interconnected panels. See e.g., FIG. 2A. In some embodiments, wherein where border 103 attaches to the plurality of interconnected panels may be at least one flex strip 111 or at least one bend strip 113. In some embodiments, at least one flex strip 111 may function as a hinge; and at least one bend strip 113 may function as a different hinge. See e.g., FIG. 1A, FIG. 1B, and FIG. 2A.

In some embodiments, one or more of, or portions of: border 103, corner panels 105, side panels 107, panel-for-door 109, flex strips 111, bend strips 113, trapdoor 115, straps 117, handles 121, fasteners 201, fasteners 205, handle 321, handle 421, door-opening 401, fasteners 403, fold lines 801, and/or the like may be substantially constructed from one or more fabrics (textiles).

In some embodiments, one or more of, or portions of: border 103, corner panels 105, side panels 107, panel-for-door 109, flex strips 111, bend strips 113, trapdoor 115, straps 117, handles 121, fasteners 201, fasteners 205, handle 321, handle 421, door-opening 401, fasteners 403, fold lines 801, and/or the like may be substantially covered in one or more fabrics (textiles).

In some embodiments, one or more of, or portions of: flex strips 111, bend strips 113, straps 117, handles 121, handle 321, handle 421, and/or the like may be substantially constructed from strapping and/or webbing (woven and/or unwoven and/or synthetic and/or natural).

In some embodiments, one or more of, or portions of, border 103, corner panels 105, side panels 107, panel-for-door 109, flex strips 111, bend strips 113, trapdoor 115, straps 117, handle(s) 121, fasteners 201, door-opening 401, fasteners 403, fold lines 801, and/or the like may be substantially constructed from one or more plastics. Such plastics may be suitable for injection molding, extrusion, die stamping, 3D printing, combinations thereof, and/or the like. For example, and without limiting the scope of the present invention, such plastics may be one or more of: acrylonitrile-butadiene styrene (ABS), polyvinyl chloride (PVC), polycarbonate, nylon, polypropylene, polyethylene (e.g., HDPE), combinations thereof, with or without fillers, with or without colorants, and/or the like.

In some embodiments, one or more of such plastic components may be substantially covered or at least partially covered with one or more fabrics; wherein such fabrics may be natural, synthetic, combinations thereof, and/or the like. In some embodiments, this covering may be substantially smooth to facilitate cleaning of mat 100. In some embodiments, this covering may be waterproof to substantially waterproof.

In some embodiments, flexible, bendable, and/or foldable elements/aspects of a given mat 100 (e.g., flex strips 111, bend strips 113, fold lines 801, living hinges, and/or trapdoor 115 hinge), combinations thereof, and/or the like may be made from flexible plastics, from fabrics, and/or from webbing/strapping.

In some embodiments, one or more of, or portions of, border 103, corner panels 105, side panels 107, panel-for-door 109, trapdoor 115, handle 121, door-opening 401, and/or the like may be substantially rigid to substantially semi-rigid.

In some embodiments, the panels (e.g., corner panels 105, side panels 107, panel-for-door 109, and/or trapdoor 115) may be substantially constructed of materials, such as, but not limited to, plastic, fabric, textiles, metal, wood, composites, laminates, glass, ceramics, cardboard, rigid materials, semi-rigid materials, combinations thereof, and/or the like.

Note with respect to the materials of construction, it is not desired nor intended to thereby unnecessarily limit the present invention by reason of such disclosure.

A mat with different operational configurations (e.g., a substantially flat work surface configuration, a funnel like collection configuration, and a folded storage configuration) has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A mat for facilitating clean up, the mat comprising:

a plurality of interconnected panels comprising at least one central panel and at least eight panels disposed around the at least one central panel; wherein the at least one central panel comprises at least one trapdoor; wherein the at least one trapdoor is removably openable and closeable; and at least two straps, wherein each strap selected from the at least two straps is an elongate member that comprises two opposing terminal ends, wherein all the opposing terminal ends of the at least two straps are attached to different upper portions of the mat;

wherein the mat is transitional into at least one of three main configurations: a a substantially flat work surface configuration, a funnel collection configuration, and a folded configuration;

wherein when the mat is in the substantially flat work surface configuration, the mat is substantially flat and substantially planar; wherein when the mat is in the funnel collection configuration, a middle region of the at least two straps is configured to be located at a highest location of the mat and the at least one trapdoor is configured to be located at a lowest location of the mat; and wherein when the mat is in the folded configuration, the plurality of interconnected panels are stacked on top of each other.

2. The mat according to claim 1, wherein each panel selected from the plurality of interconnected panels is attached to at least two adjacent panels selected from the plurality of interconnected panels.

3. The mat according to claim 2, wherein this attachment between each panel selected from the plurality of interconnected panels and the at least two adjacent panels selected from the plurality of interconnected panels is by at least one flex strip and by at least one bend strip; wherein the at least one flex strip functions as a hinge; wherein the at least one bend strip functions as a different hinge.

4. The mat according to claim 3, wherein the at least one flex strip and the at least one bend strip are substantially orthogonal with respect to each other.

5. The mat according to claim 3, wherein the at least one flex strip and the at least one bend strip are substantially linear when the mat is in the substantially flat work surface configuration.

6. The mat according to claim 1, wherein each panel selected from the plurality of interconnected panels is substantially flat and planar.

7. The mat according to claim 1, wherein each panel selected from the plurality of interconnected panels is at least semi-rigid to rigid.

8. The mat according to claim 1, wherein each panel selected from the plurality of interconnected panels is substantially covered in at least one fabric.

9. The mat according to claim 1, wherein the at least eight panels, selected from the plurality of interconnected panels, comprises four corner panels and four side panels; wherein the four corner panels are located towards corners of the mat; wherein disposed between two of the four corner panels is one of the four side panels.

10. The mat according to claim 9, wherein each of the opposing terminal ends of the at least two straps are attached to one of the four corner panels, such that the at least two straps are substantially orthogonal to each other when the mat is in the substantially flat work surface configuration.

11. The mat according to claim 1, wherein when the mat is in the substantially flat work surface configuration, the at least two straps lay substantially flat upon at least some of the panels selected from the plurality of interconnected panels.

12. The mat according to claim 1, wherein each strap selected from the at least two straps is longer than three panels, selected from the plurality of interconnected panels, wherein the three panels are with respect to those three panels arranged linearly end to end.

13. The mat according to claim 1, wherein the at least one trapdoor opens downwards beneath the at least one central panel.

14. The mat according to claim 1, wherein at least one panel selected from the plurality of interconnected panels comprises at least one handle attached to an upper surface of that at least one panel.

15. The mat according to claim 1, wherein the mat further comprises a border; wherein the border is located along an outside peripheral edge of the plurality of interconnected panels, such that the plurality of interconnected panels is bound within the border.

16. The mat according to claim 15, wherein the border comprises a fixed and a predetermined width that runs around the outside peripheral edge of the plurality of interconnected panels.

17. The mat according to claim 15, wherein when the mat is in the substantially flat work surface configuration, the mat when viewed from above has a polygon shape; wherein proximate to each corner of that polygon shape are a pair of complimentary fasteners configured to removably attach to each other; wherein when all of the pairs of complimentary fasteners are removably attached to each other, the border folds into planes that are substantially orthogonal with respect to a common plane of the plurality of interconnected panels, when the plurality of interconnected panels are substantially flat and planar.

18. The mat according to claim 15, wherein the border comprises an outer edge that defines a boundary of the mat; wherein disposed opposite of the outer edge, by a width of the border, is where the border attaches to the plurality of interconnected panels.

19. The mat according to claim 18, wherein at or proximate to the outer edge is a plurality of fasteners.

20. The mat according to claim 19, wherein where the border attaches to the plurality of interconnected panels is at least one flex strip or at least one bend strip; wherein the at least one flex strip functions as a hinge; wherein the at least one bend strip functions as a different hinge.

* * * * *